US005639157A

United States Patent [19]

Yeh

[11] Patent Number: 5,639,157

[45] Date of Patent: Jun. 17, 1997

[54] DECORATIVE STRING LIGHTING SYSTEM

[76] Inventor: Ren Shan Yeh, 521 S. El Paso, El Paso, Tex. 79901

[21] Appl. No.: 538,230

[22] Filed: Oct. 3, 1995

[51] Int. Cl.[6] ..... F21P 3/00

[52] U.S. Cl. ..... 362/123; 362/32; 362/806

[58] Field of Search ..... 362/32, 121, 122, 362/123, 252, 800, 806

[56] References Cited

U.S. PATENT DOCUMENTS

| | | | |
|---|---|---|---|
| 2,802,095 | 8/1957 | Denning et al. | 240/52.1 |
| 3,035,162 | 5/1962 | Emmich | 362/123 |
| 3,564,233 | 2/1971 | Cox et al. | 362/123 |
| 3,789,211 | 1/1974 | Kramer | 240/10 R |
| 4,215,277 | 7/1980 | Weiner et al. | 307/41 |
| 4,259,709 | 3/1981 | Eddings | 362/231 |
| 4,264,845 | 4/1981 | Bednarz | 315/323 |
| 4,415,953 | 11/1983 | Shepherd | 362/32 |
| 4,417,182 | 11/1983 | Weber | 315/210 |
| 4,510,555 | 4/1985 | Mori | 362/32 |
| 4,777,571 | 10/1988 | Morgan | 362/123 |
| 4,878,157 | 10/1989 | Koch | 362/123 |
| 5,226,709 | 7/1993 | Labranche | 362/32 |
| 5,245,519 | 9/1993 | Openiano | 362/252 |
| 5,315,492 | 5/1994 | Davenport | 362/122 |
| 5,422,797 | 6/1995 | Shattan | 362/123 |
| 5,422,801 | 6/1995 | Sangalli, Jr. | 362/252 |

*Primary Examiner*—Ira S. Lazarus
*Assistant Examiner*—Alfred Basichas
*Attorney, Agent, or Firm*—Charles C.H. Wu

[57] ABSTRACT

A decorative light string includes a multiplicity of illuminators; a multiplicity of light output transducers, each of the illuminators receiving light from at least one corresponding light output transducer; a wire harness connected to the illuminators, the harness having a principal portion, a multiplicity of feeder members extending from spaced feeder locations on the principal portion to respective illuminators for permitting the illuminators to be located at respective distances from the principal portion, the distances being greater than the spacing between the feeder locations, at least one of the illuminators including a corresponding one of the light output transducers, the corresponding feeder including a pair of conductors extending from the corresponding feeder location of the harness, the pair of conductors being connected to the transducer; and an AC powered control circuit connected to a plurality of circuit paths of the wire harness, the control circuit being capable of sequentially driving the circuit paths for activating corresponding subsets of the light output transducers, the light output transducers of each circuit path being series-connected, adjacent ones of the light output transducers being in different ones of the circuit paths.

6 Claims, 2 Drawing Sheets

HI225 XL
I.C.
AC

DECORATIVE STRING LIGHTING SYSTEM

BACKGROUND

The present invention relates to decorative lighting for displays such as Christmas trees and the like.

String lighting systems are known in the prior art, being disclosed, for example in U.S. Pat. Nos. 4,264,845 to Bednarz and 4,259,709 to Eddings. Specifically disclosed are flash circuits, sound and/or music elements to which the illuminators can be responsive. The string lights of the prior art still have disadvantages, including one or more of the following:

1. They are awkward to use in that they are restricted to a serpentine pattern;

2. They are difficult to support with the illuminators in desired locations on a Christmas tree in that the string presents excessive force loading at the individual illuminators for support thereof by fragile and limber branch extremities of the tree; and 4. They are visually unattractive in that major portions of string wiring are exposed to view.

It is also known to provide string lights with ornamentally shaped incandescent bulbs and/or ornamented sculptures that are lighted by the illuminators. U.S. Pat. No. 3,789,211 to Kramer discloses a string of ornaments having three differently colored lamps extending therein, the lamps of each color being pulsed at slightly different frequencies for producing randomly changing colored illumination of the ornaments. Unfortunately, these string lights are subject to each of the disadvantages listed above, only more so in that the lighted ornaments are significantly heavier than individual lamps.

Thus there is a need for a string light system that avoids the disadvantages of the prior art.

SUMMARY

The present invention meets this need by providing a light string that has a plurality of illuminators that are physically spaced from a principal wire harness portion of the string. In one aspect of the invention, the light string includes a multiplicity of illuminators, a power cord for connection to a source of electrical power, and a wire harness for feeding the power to the illuminators, the harness having a principal portion, a multiplicity of feeder members extending from spaced feeder locations on the principal portion to respective illuminators for permitting the illuminators to be located at respective distances from the principal portion, the distances being greater than the spacing between the feeder locations.

The light string can further include a multiplicity of light output transducers, each of the illuminators receiving light from at least one corresponding light output transducer. The light string can further include a control circuit connected between the power cord and the wire harness, the harness having a plurality of circuit paths therein, the control circuit being capable of separately driving each of the circuit paths for activating corresponding subsets of the light output transducers.

The light output transducers of each circuit path can be series-connected. Adjacent ones of the light output transducers can be in different circuit paths. The control circuit can be capable of sequentially driving the circuit paths. The control circuit can be selectively operable in a steady state mode having each of the circuit paths continuously powered.

At least one of the illuminators can include a translucent ornament body, the corresponding feeder including a coupler member supported relative to a coupler subset of the light output transducers, each transducer of the coupler subset being in a different one of the circuit paths, the coupler member being formed for receiving light from the coupler subset of the transducers and transmitting the light within the coupler member; means for producing spectrally distinct light from each of the illuminators of the coupler subset; a fiber optic element, opposite ends of the element being optically connected between the coupler member and the ornament body transmitting at least a portion of light from the light output transducers into the ornament body, whereby the ornament body is illuminated in colors corresponding to activated ones of the transducers of the coupler subset.

At least one of the illuminators can include a corresponding one of the light output transducers, the corresponding feeder including a pair of conductors extending from the corresponding feeder location of the harness, the pair of conductors being connected to the transducer for powering same. The principal portion of the wire harness can include a plurality of branch segments, adjacent ones of the branch segments joining at respective branch locations, at least some of the branch locations being spaced apart on the principal portion, a plurality of the branch segments each having a plurality of the feeder locations thereon.

In another aspect of the invention, the light string includes the multiplicity of light output transducers; a control circuit powered from an external source for activating the transducers, the transducers of an illuminator subset being in separate circuit paths for independent activation by the control circuit; a translucent illuminator body; a fiber-optic element, one end of the element being optically connected to the illuminator body; and a coupler member optically connected to an opposite end of the fiber optic element, the coupler member being supported relative to the illuminator subset of the transducers, the coupler member being formed for receiving light from the illuminator subset and transmitting the light into the fiber-optic element for lighting the illuminator body; means for producing spectrally distinct light from each transducer of the of the illuminator subset, whereby the illuminator body is lighted in colors corresponding to activated ones of the transducers of the coupler subset.

The transducers of the illuminator subset can be incandescent bulbs, the means for producing spectrally distinct light including colored translucent elements of the bulbs. At least two transducers of the illuminator subset can be light-emitting diodes (LEDs), the means for producing spectrally distinct light including the LEDs having different radiation spectra when activated by the control circuit. The illuminator subset can include four light output transducers that are being colored respectively red, yellow, green and blue.

DRAWINGS

These and other features, aspects, and advantages of the present invention will become better understood with reference to the following description, appended claims, and accompanying drawings, where:

DESCRIPTION

Figure 1:
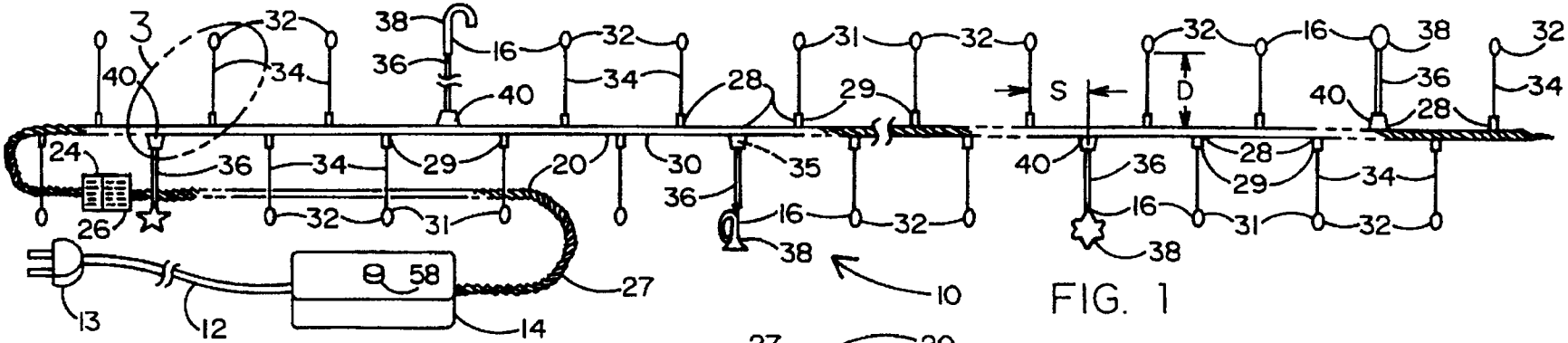
FIG. 1 is a side elevational view of a light string system according to the present invention.
Figure 2:
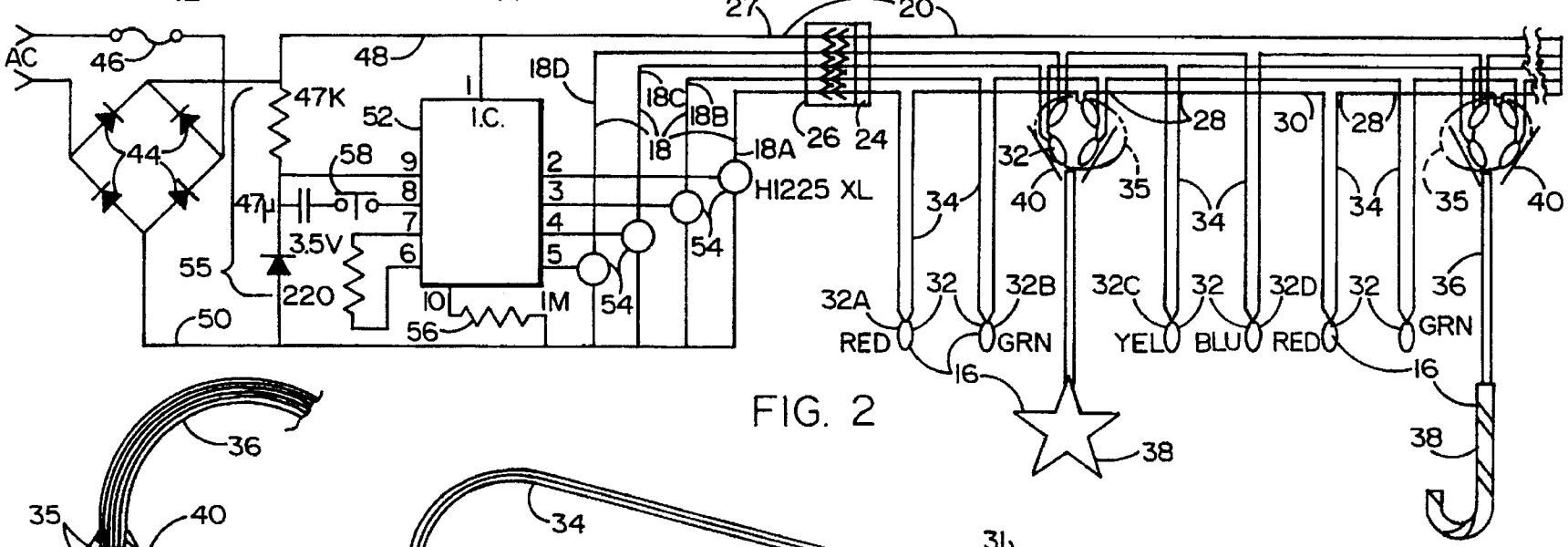
FIG. 2 is a schematic circuit diagram of the light string system of FIG. 1.
Figure 3:
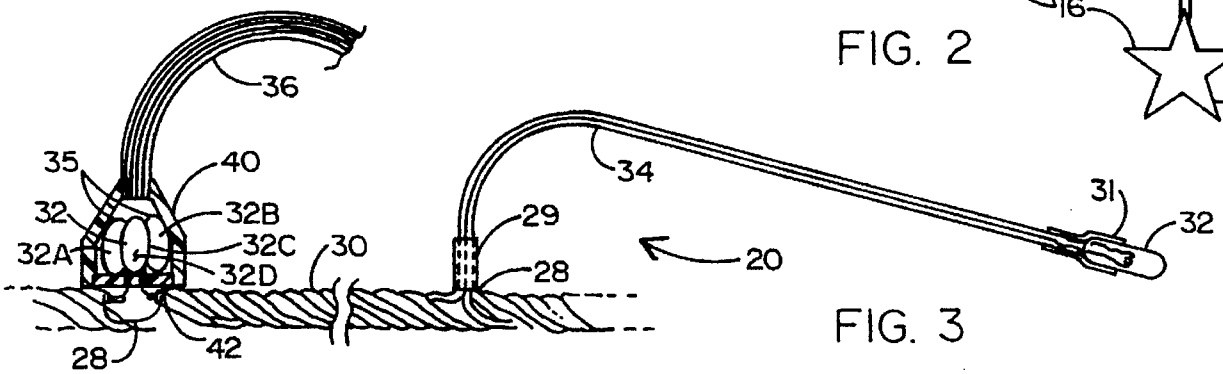
FIG. 3 is a fragmentary sectional detail view of a feeder portion the light string system within region 3 of FIG. 1.

The present invention is directed to a string light system that is particularly suitable for decorating Christmas trees and the like. With reference to FIGS. 1–3 of the drawings, a string light system 10 has a conventional power cord 12 having a plug connection 13 to a standard AC electrical power source (not shown), the power cord 12 being connected to a control unit 14 for activating a multiplicity of illuminators 16 of the system 10 by driving separate circuit paths 18 of a wiring harness 20, the circuit paths being individually designated 18A, 18B, 18C, and 18D. Optionally, the harness 20 includes a segment plug 24 and a segment socket 26, the socket 26 being spaced from the control unit 14, at the free end of an umbilical portion 27.

According to the present invention, a plurality of feeder locations 28 are spaced along a principal portion 30 of the harness 20, respective ones of the illuminators 16 being spaced from the principal portion 30 at distances D that are typically greater than respective spacings S between the corresponding feeder locations 28. More particularly, a plurality of light output transducers 32 are connected in each of the circuit paths 18, some of the transducers 32 may function as corresponding ones of the illuminators 16 in the exemplary configuration of FIGS. 1–3. For each of the transducers 32 that serve directly as the illuminators 16, a pair of conductors 34 extends from the associated feeder location 28, being connected to the corresponding output transducer 32 for completing the associated circuit path 18. The conductors 34 also extend within the principal portion 30 of the harness 20, being clamped proximate the associated feeder locations 28 by respective feeder sleeves 29 which can be short lengths of shrink tubing. Also, the connections of the conductors 34 to those transducers 32 are reinforced and insulated by respective lamp sleeves 31 as shown in FIG. 3. In a typical example of the system 10, the light output transducers 32 that are associated with each of the circuit paths 18 are correspondingly colored so that activation of only one of the circuit paths 18 results in lighting from the system 10 being in the corresponding color only. As shown in FIG. 2, the light output transducers 32, being colored red, green, yellow, and blue in the corresponding circuit paths 18A, 18B, 18C, and 18D are respectively designated 32A, 32B, 32C, and 32D. Suitable devices for the light output transducers are low voltage incandescent lamps and light-emitting diodes (LEDs), series-connected in the respective circuit paths 18 as shown in FIG. 2.

As further shown in FIG. 1, the wire harness 20 has some of the light output transducers 32 in respective coupler subsets 35 for coupling by associated fiber-optic elements 36 to corresponding ones of the illuminators 16, each illuminator 16 of the second segment being formed by a translucent ornament body 38 to which a free end of the fiber-optic element 36 is connected. The transducers 32 of each subset 35, being grouped in close proximity, are supported within a coupler member 40 for light transmission into the associated fiber-optic element 36, the element 36 extending from the coupler member 40. The light output transducers of each coupler subset 35, being in the separate circuit paths 18A, 18B, 18C, and 18D for independent activation by the control unit 14 as described above, are also designated 32A, 32B, 32C, and 32D as shown in FIG. 3. As further shown in drawings, the coupler members 40, together with the transducers 32 of each subset 35, are located proximate counterparts of the feeder locations 28 on the principal portion 30 of the harness 20. As further shown in FIG. 3, the transducers 32 of each subset 35 are mounted to a base member 42, the base member 42 being connected to the corresponding collector member 40 for support thereof. Also, the base members 42 can project on opposite sides of the principal portion 30 of the harness 20 for stabilizing the coupler members 40 relative to the feeder locations 28. As described above, the transducers 32 of the coupler subsets 35 can be variously colored incandescent lamps and/or LEDs. Alternatively, separate colored translucent elements can be interposed between the individual lamps and the fiber-optic elements 36.

The control unit 14 includes four diodes 44 forming a full wave bridge rectifier that is powered by standard 117 volt AC power from the power cord 12, through a fuse link 46, for producing rectified direct current on a power bus 48 relative to a ground bus 50, the power bus 48 providing a common connection for each of the circuit paths 18 in the harness 20. An integrated circuit 52 activates each of the circuit paths 18 by driving corresponding semiconductor drivers 54 that are connected between the respective circuit paths 18 and the ground bus 50, the integrated circuit 52 being also powered between the power bus 48 and the ground bus 50 by means of a 3.5 volt zener diode regulator 55 and a dropping or biasing resistor 56. The integrated circuit 52 is toggled between flashing and steady state modes by a push-button switch 58. In the flashing mode, the circuit paths 18 are activated in an ever-changing sequence that varies in frequency and duty-cycle, and in the particular one or ones of the circuits 18 that are being flashed. Particularly, all of the circuit paths are first activated at full power, the power being gradually diminished to approximately zero over a period of about 15 seconds, and then gradually restored, the process gradually increasing in frequency. Another portion of the flashing mode includes full power being applied to one only of the circuit paths 18 at a time, and another of the circuit paths having increasing power applied as power is diminished on the other circuit path 18, the cycle advancing through each of the circuit paths 18, whereby the system 10 produces an overall effect of smoothly progressing color changes when each of the circuit paths 18 activates a unique color output, the color changes progressing at an ever increasing rate. A further portion of the flashing mode includes pairs of the circuit paths 18 being alternately flashed at increasing rates. A device suitable for use as the Control Unit 14 is available as E 127591 Multi-Pattern Light Controller from Wei Shin Electronic Co. of Tung Koon, Kwang Tung, China. The integrated circuit 52 therein is operable by phase modulation of the AC power, the output connections to the drivers 54 being appropriately configured for the specific devices being used as the drivers 54, which can be transistors, SCRs or triacs, the actual drivers 54 being H 1225 XL transistors. In the configuration of FIGS. 1–3, there are a total of 200 of the light output transducers 32, 50 being series-connected in each of the four circuit paths 18.

Figure 4:
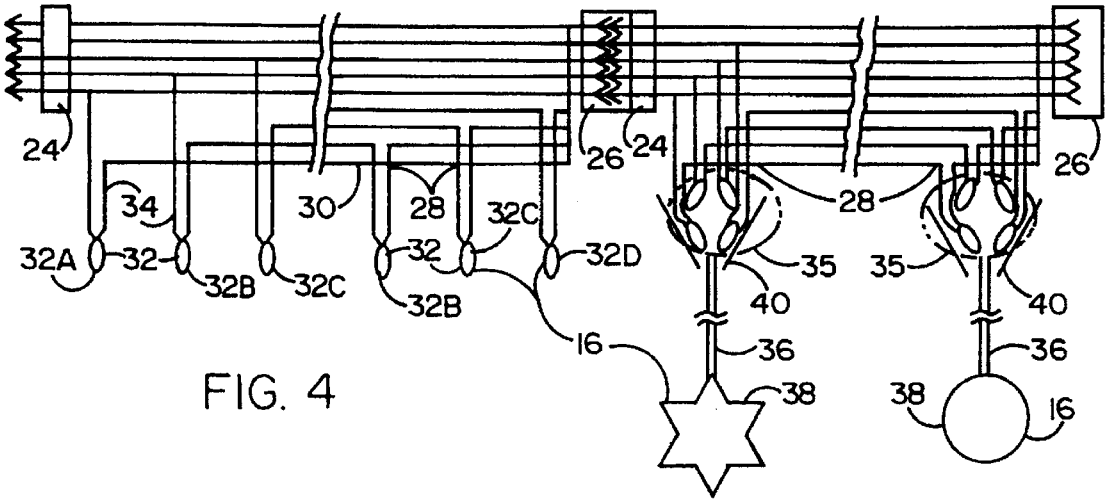
FIG. 4 is a schematic circuit diagram showing an alternative configuration of a wire harness portion of the light string system of FIG. 1.
Figure 5:
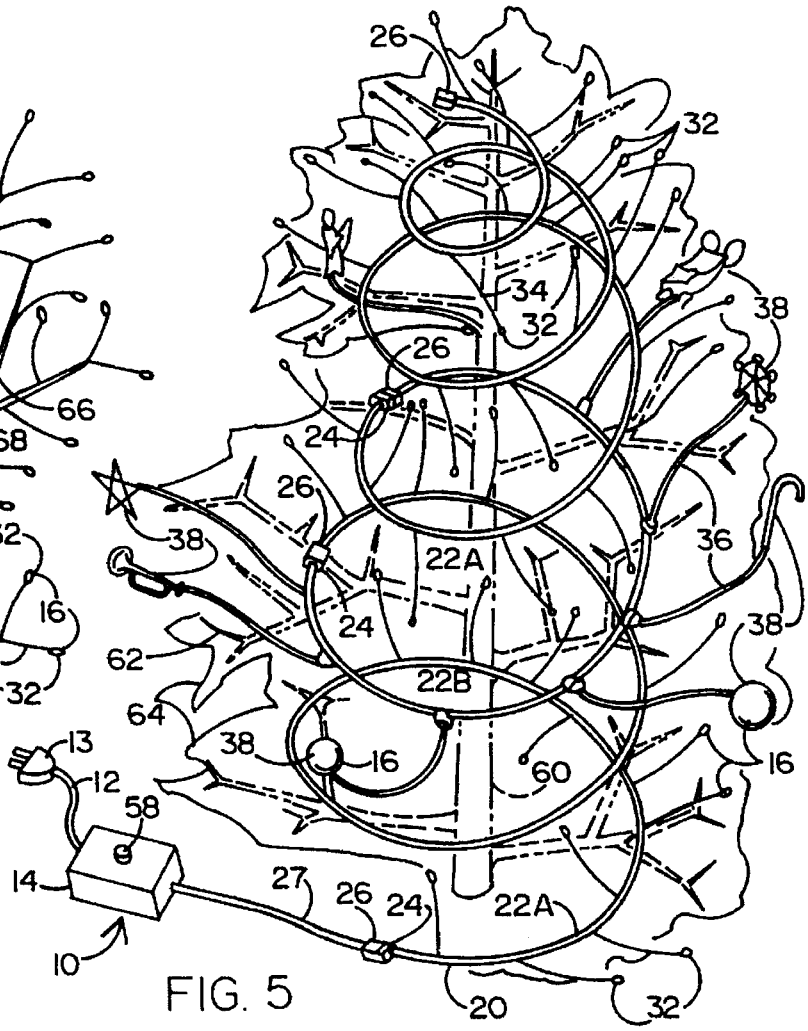
FIG. 5 is an oblique elevational perspective view of the light string system of FIG. 4 deployed on a Christmas tree.

With further reference to FIGS. 4 and 5, an alternative configuration of the system 10 has the wiring harness 20 is segmented, including a first segment 22A and a second segment 22B (the segments being collectively referred to as 22), and each segment 22 having counterparts of the segment plug 24 and the segment socket 26 at opposite ends thereof whereby the segments 22 can be connected in any order to achieve a desired ornamental effect. As shown in FIG. 4, the first segment 22A has the illuminators 16 formed by the ornament bodies 38, the light output transducers 32 in the subsets 35 within the coupler members 40 at the feeder locations 28, and the fiber-optic elements optically connected between the respective subsets 35 and the corresponding ornament bodies 38. The second segment 22B has each of the illuminators 16 formed by respective ones of the light output transducers 32. In each of the circuit paths 18, the light output transducers 32 of each segment 22 are connected in series, the segments 22 forming parallel branches of each circuit path 18. Thus the number of the segments 22 that can be operated at once is limited by the current capacity of the semiconductor drivers 54. FIG. 5 shows two of the first segments 22A connected on opposite ends of a single second segment 22B, the principal portion 30 of the harness 20 being generally helically arranged about a trunk member 60 of a Christmas tree 62 with the illuminators 16 being variously disposed outwardly and inwardly relative to the principal portion 30. In this arrangement, the principal portion 30 of the harness 20 can be advantageously located approximately the distance D inwardly from outwardly extending ones of the illuminators 16, being easily hidden by foliage 64 of the tree 62. Also, the inside portions of the tree 62 can be illuminated by inwardly extending ones of the illuminators 16, without having to dedicate significant parts of the principal portion 30 in traversing between outside and inside ones of the illuminators 16. Further, the feeder configuration of the system 10 permits the principal portion to occupy a relatively short simple path within the tree 62 between the trunk member 60 and outsides of the foliage 64, in regions where branches of the foliage 64 have significant strength and stiffness for supporting same.

Figure 6:
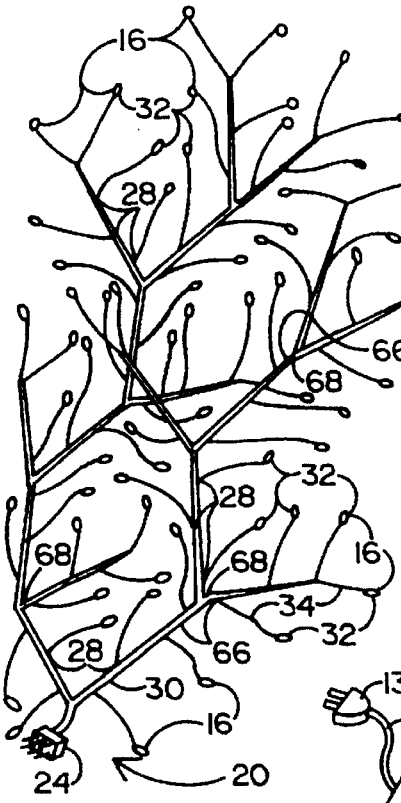
FIG. 6 is an elevational view showing another alternative configuration of the light string system of FIG. 1.

With further reference to FIG. 6, an alternative configuration of the harness 20 includes a plurality of branch segments 66, adjacent ones of the branch segments 66 joining at respective branch locations 68. The branch segments 66 are spaced apart such that at least some of the branch segments 66 each have a plurality of the feeder locations 28 spaced thereon for permitting a wide variety of lighting arrangements by the system 10.

Although the present invention has been described in considerable detail with reference to certain preferred versions thereof, other versions are possible. For example, the control unit 14 can be configured with an integrally mounted power plug. Also, the control unit 14 can be omitted when only the continuous mode of operation is desired. Further, the light output transducers of the subsets 35 can be in different colors in corresponding ones of the circuit paths 18 for simultaneously illuminating the ornament bodies 38 in different colors when the various circuit paths 18 are activated by the control unit 14. Therefore, the spirit and scope of the appended claims should not necessarily be limited to the description of the preferred versions contained herein.

What is claimed is:

1. A decorative light string comprising:

(a) a multiplicity of illuminators, at least one of the illuminators comprises a translucent ornament body;

(b) a multiplicity of light output transducers, each of the illuminators receiving light from at least one corresponding light output transducer;

(c) a power cord for connection to a source of electrical power;

(d) a wire harness for feeding the power to the illuminators, the harness having a principal portion, a multiplicity of feeder members extending from spaced feeder locations on the principal portion to respective illuminators for permitting the illuminators to be located at respective distances from the principal portion, the distances being greater than the spacing between the feeder locations, at least one of the illuminators comprising a corresponding one of the light output transducers, the corresponding feeder comprising a coupler subset of the light output transducers, each transducer of the coupler subset being in a different one of the circuit paths, the coupler member being formed for receiving light from the coupler subset of the transducers and transmitting the light within the coupler member, means for producing spectrally distinct light from each of the illuminators of the coupler subset, and a fiber optic element, opposite ends of the element being optically connected between the coupler member and the ornament body transmitting at least a portion of light from the light output transducers into the ornament body; and (e) a control circuit connected between the power cord and the wire harness, the harness having a plurality of circuit paths therein, the control circuit being capable of sequentially driving the circuit paths for activating corresponding subsets of the light output transducers, the light output transducers of each circuit path being series-connected, adjacent ones of the light output transducers being in different ones of the circuit paths.

2. A decorative light string comprising:

(a) a multiplicity of light output transducers;

(b) a control circuit powered from an external source for activating the light output transducers, the light output transducers being in separate circuit paths for independent activation by the control circuit;

(c) a translucent illuminator body;

(d) a fiber-optic element, one end of the element being optically connected to the illuminator body; and (e) a coupler member optically connected to an opposite end of the fiber optic element, the coupler member being supported relative to the illuminator subset of the transducers, the coupler member formed for receiving light from the illuminator subset and transmitting the light into the fiber-optic element for lighting the illuminator body;

(f) means for producing spectrally distinct light from each transducer of the illuminator subset, whereby the illuminator body is lighted in colors corresponding to activated ones of the transducers of the coupler subset.

3. The light string of claim 2, wherein the transducers of the illuminator subset are incandescent bulbs, and the means for producing spectrally distinct light comprises colored translucent elements of the bulbs.

4. The light string of claim 2, wherein at least two transducers of the illuminator subset are LEDs, and the means for producing spectrally distinct light comprises the LEDs having different radiation spectra when activated by the control circuit.

5. The light string of claim 2, wherein the illuminator subset includes four light output transducers, the four transducers being colored respectively red, yellow, green and blue.

6. A decorative light string comprising:

(a) a multiplicity of illuminators;

(b) a multiplicity of light output transducers, each of the illuminators receiving light from at least one corresponding light output transducer;

(c) a power cord for connection to a source of electrical power;

(d) a wire harness for feeding the power to the illuminators, the harness having a principal portion, a multiplicity of feeder members extending from spaced feeder locations on the principal portion to respective illuminators for permitting the illuminators to be located at respective distances from the principal portion, the distances being greater than the spacing between the feeder locations, at least one of the illuminators comprising a corresponding one of the light output transducers, the corresponding feeder comprising a pair of conductors extending from the corresponding feeder location of the harness, the pair of conductors being connected to the transducer for powering the illuminators; and (e) a control circuit connected between the power cord and the wire harness, the harness having a plurality of circuit paths therein, the control circuit being capable of sequentially driving the circuit paths for activating corresponding subsets of the light output transducers, the light output transducers of each circuit path being series-connected, adjacent ones of the light output transducers being in different ones of the circuit paths.

* * * * *